US011244778B2

(12) United States Patent
Iwasaki et al.

(10) Patent No.: US 11,244,778 B2
(45) Date of Patent: Feb. 8, 2022

(54) R-T-B BASED PERMANENT MAGNET

(71) Applicant: TDK CORPORATION, Tokyo (JP)

(72) Inventors: Makoto Iwasaki, Tokyo (JP); Akihiro Harada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/822,772

(22) Filed: Mar. 18, 2020

(65) Prior Publication Data

US 2020/0303097 A1 Sep. 24, 2020

(30) Foreign Application Priority Data

Mar. 20, 2019 (JP) ..... JP2019-053655

(51) Int. Cl.
*H01F 1/057* (2006.01)
*C22C 30/02* (2006.01)

(52) U.S. Cl.
CPC ..... *H01F 1/057* (2013.01); *C22C 30/02* (2013.01); *C22C 2202/02* (2013.01)

(58) Field of Classification Search
None
See application file for complete search history.

(56) References Cited

U.S. PATENT DOCUMENTS

2016/0163435 A1 6/2016 Miwa et al.
2017/0103836 A1* 4/2017 Hidaka ..... C22C 38/06

FOREIGN PATENT DOCUMENTS

JP 2016184735 * 10/2016
WO 2015/020180 A1 2/2015

OTHER PUBLICATIONS

English language machine translation of JP2016184735. Generated Mar. 25, 2021. (Year: 2021).*

* cited by examiner

*Primary Examiner* — Brian D Walck
(74) *Attorney, Agent, or Firm* — Oliff PLC

(57) ABSTRACT

An R-T-B based permanent magnet wherein R is one or more rare earth elements, T is Fe and Co, and B is boron. The R-T-B based permanent magnet includes M, C and N, wherein M is two or more selected from Cu, Ga, Mn, Zr, and Al, and includes at least Cu and Ga. A total content of R is ≥29.0 and ≤33.5 mass %, Co content is ≥0.10 and ≤0.49 mass %, B content is ≥0.80 and ≤0.96 mass %, a total content of M is ≥0.63 and ≤4.00 mass %, Cu content is ≥0.51 and ≤0.97 mass %, Ga content is ≥0.12 and ≤1.07 mass %, C content is ≥0.065 and ≤0.200 mass %, N content is ≥0.023 and ≤0.323 mass %, and Fe is a substantial balance.

5 Claims, No Drawings

R-T-B BASED PERMANENT MAGNET

TECHNICAL FIELD

The present invention relates to an R-T-B based permanent magnet.

BACKGROUND

Patent Document 1 discloses an R-T-B based sintered magnet having $R_2T_{14}B$ crystal grains. A grain boundary formed between two or more adjacent $R_2T_{14}B$ crystal grains has an R—Ga—Co—Cu—N concentrated part wherein concentrations of R, Ga, Co, Cu, and N are higher than in the $R_2T_{14}B$ crystal grains. Patent Document 1 also discloses that the R-T-B based sintered magnet shows an outstanding corrosion resistance and good magnetic properties due to the above feature.

[Patent Document 1] WO 2015/020180

SUMMARY

Currently, there is a demand for an R-T-B based permanent magnet having good magnetic properties and corrosion resistance.

An object of the present invention is to provide an R-T-B based permanent magnet having good residual magnetic flux density Br, coercive force HcJ, and corrosion resistance.

In response to the above object, the R-T-B based permanent magnet according to the present invention is an R-T-B based permanent magnet in which R is one or more rare earth elements, T is a combination of Fe and Co, and B is boron, wherein the R-T-B based permanent magnet includes M, C, and N, wherein M is two or more selected from Cu, Ga, Mn, Zr, and Al, and includes at least Cu and Ga, and relative to 100 mass % of the R-T-B based permanent magnet, a total content of R is 29.0 mass % or more and 33.5 mass % or less, Co content is 0.10 mass % or more and 0.49 mass % or less, B content is 0.80 mass % or more and 0.96 mass % or less, a total content of M is 0.63 mass % or more and 4.00 mass % or less, Cu content is 0.51 mass % or more and 0.97 mass % or less, Ga content is 0.12 mass % or more and 1.07 mass % or less, C content is 0.065 mass % or more and 0.200 mass % or less, N content is 0.023 mass % or more and 0.323 mass % or less, and Fe is a substantial balance.

An R-T-B based permanent magnet of the present invention shows good Br, HcJ, and corrosion resistance.

Mn content may be 0.02 mass % or more and 0.08 mass % or less.

Zr content may be 0.15 mass % or more and 0.42 mass % or less.

Al content may be 0.08 mass % or more and 0.41 mass % or less.

The total content of Co, Cu and Al may be 1.00 mass % or more and 2.00 mass % or less.

The total content of Co and Mn may be 0.40 mass % or more and 1.00 mass % or less.

DETAILED DESCRIPTION

Hereinafter, an embodiment of the present invention is explained.

<R-T-B Based Permanent Magnet>

Described is an R-T-B based permanent magnet according to the present embodiment. The R-T-B based permanent magnet includes main phase grains consisting of crystal grains having an $R_2T_{14}B$ type crystal structure. The R-T-B based permanent magnet according to the present embodiment has grain boundaries existing between two or more adjacent main phase grains. The R-T-B based permanent magnet according to the present embodiment may have an R—Ga—Co—Cu—N concentrated part in the grain boundaries wherein concentrations of R, Ga, Co, Cu, and N are higher than in the main phase grains.

An average grain size of the main phase grains is usually 1 μm to 30 μm or so.

The grain boundaries include a grain boundary existing between two adjacent main phase grains (two-grain boundary) and a grain boundary surrounded by three or more adjacent main phase grains (grain boundary multiple junction). The R—Ga—Co—Cu—N concentrated part is a region that exists in the grain boundaries and has a higher concentration of R, Ga, Co, Cu, and N than in the main phase grains. The R—Ga—Co—Cu—N concentrated part may contain other components if R, Ga, Co, Cu, and N are contained as main components.

The grain boundaries of the R-T-B based permanent magnet according to the present embodiment includes at least the above-mentioned R—Ga—Co—Cu—N concentrated part. In addition to the R—Ga—Co—Cu—N concentrated part, it may contain an R-rich phase having a higher R concentration, a B-rich phase having a higher boron (B) concentration, and the like than the $R_2T_{14}B$ crystal grains.

The R-T-B based permanent magnet of the present embodiment may be a sintered body formed using an R-T-B based alloy.

R represents at least one selected from a rare earth element. The rare earth element includes Sc, Y, and lanthanoid, which belong to a third group of a long period type periodic table. For example, the lanthanoid includes La, Ce, Pr, Nd, Sm, Eu, Gd, Tb, Dy, Ho, Er, Tm, Yb, Lu, and the like. A rare earth element is classified into a light rare earth element and a heavy rare earth element. A heavy rare earth element includes Gd, Tb, Dy, Ho, Er, Tm, Yb, and Lu. A light rare earth element is a rare earth element other than the heavy rare earth element. In the present embodiment, from the viewpoint of suitably controlling a production cost and the magnetic properties, Nd and/or Pr maybe included as R. Moreover, both light rare earth element and heavy rare earth element may be included from the viewpoint of making HcJ large. The content of the heavy rare earth element is not particularly limited, and the heavy rare earth element may not be included. The content of the heavy rare earth element is for example 5 mass % or less (including 0 mass %).

According to the present embodiment, T is a combination of Fe and Co, and B is boron.

R content in the R-T-B based permanent magnet of the present embodiment is 29.0 mass % or more and 33.5 mass % or less. When R content is too low, the main phase grains of the R-T-B-based permanent magnet are not formed enough. Therefore, α-Fe and the like having a soft magnetism tends to be precipitated, and HcJ tends to decrease.

When R content is too high, a volume ratio of the main phase grains of the R-T-B based permanent magnet decreases and Br decreases.

B content in the R-T-B based permanent magnet of the present embodiment is 0.80 mass % or more and 0.96 mass % or less, and may be 0.80 mass % or more and 0.90 mass % or less. When B content is too low, HcJ decreases and sinterability decreases. When B content is too high, an abnormal grain growth is likely to occur, and Br and the corrosion resistance decreases.

T is a combination of Fe and Co. Co content of the R-T-B based permanent magnet according to the present embodiment is 0.10 mass % or more and 0.49 mass % or less, may be 0.10 mass % or more and 0.44 mass % or less, may be 0.20 mass % or more and 0.42 mass % or less, and may be 0.20 mass % or more and 0.39 mass % or less. When Co content is too low, it becomes difficult to form the R—Ga—Co—Cu—N concentrated part, and the corrosion resistance decreases. When Co content is too high, Br and HcJ decrease. In addition, the R-T-B based permanent magnet of the present embodiment tends to become expensive.

The R-T-B based permanent magnet of the present embodiment further includes M. M is at least two selected from Cu, Ga, Mn, Zr, and Al; and contains at least Cu and Ga. The total content of M is not particularly limited, and it is 0.63 mass % or more and 4.00 mass % or less.

Cu content of the R-T-B based permanent magnet according to the present embodiment is 0.51 mass % or more and 0.97 mass % or less, may be 0.53 mass % or more and 0.97 mass % or less, and may be 0.55 mass % or more and 0.80 mass % or less. By sufficiently containing Cu, the R—Ga—Co—Cu—N concentrated part is sufficiently formed even if Co content is 0.49 mass % or less. When Cu content is too small, it becomes difficult to form the R—Ga—Co—Cu—N concentrated part, and the corrosion resistance decreases. When the Cu content is too high, Br decreases.

Ga content of the R-T-B based permanent magnet according to the present embodiment is 0.12 mass % or more and 1.07 mass % or less, may be 0.13 mass % or more and 1.06 mass % or less, and may be 0.55 mass % or more and 0.82 mass % or less. By sufficiently containing Ga, the R—Ga—Co—Cu—N concentrated part is sufficiently formed even if Co content is 0.49 mass % or less. When Ga content is too low, it becomes difficult to form an R—Ga—Co—Cu—N concentrated part, and the corrosion resistance is lowered. When Ga content is too high, Br decreases.

The R-T-B based permanent magnet according to the present embodiment may contain Al if necessary. By containing Al, the R—Ga—Co—Cu—N concentrated part is sufficiently formed even if Co content is 0.49 mass % or less. Al content is not particularly limited, and Al may not be contained. For example, Al content may be 0.08 mass % or more and 0.41 mass % or less, and may be 0.10 mass % or more and 0.19 mass % or less. HcJ and the corrosion resistance are likely to decrease as Al content decreases. Br tends to decrease as Al content increases.

The R-T-B based permanent magnet according to the present embodiment may contain Zr if necessary. By containing Zr, a ZrB phase tends to be easily formed in the grain boundaries. By forming the ZrB phase, the corrosion resistance is improved and the magnetic properties are stabilized even when the sintering temperature varies. Zr content is not particularly limited, and Zr may not be contained. For example, Zr content may be 0.15 mass % or more and 0.42 mass % or less, and may be 0.22 mass % or more and 0.31 mass % or less. The corrosion resistance and the sinterability tend to decrease as Zr content decreases. Br tends to decrease as Zr content increases.

The R-T-B based permanent magnet according to the present embodiment may contain Mn if necessary. By containing Mn, the R—Ga—Co—Cu—N concentrated part is sufficiently formed even if Co content is 0.49 mass % or less. Mn content is not particularly limited, and Mn may not be contained. For example, Mn content may be 0.02 mass % or more and 0.08 mass % or less, and may be 0.03 mass % or more and 0.05 mass % or less. The corrosion resistance is likely to decrease as Mn content decreases. Br and HcJ tend to decrease as Mn content increases.

The total content of Co, Cu, and Al in the R-T-B based permanent magnet of the present embodiment may be 1.00 mass % or more. When the total content of Co, Cu, and Al is 1.00 mass % or more, the corrosion resistance is easily improved. Although there is no upper limit to the total content of Co, Cu, and Al, for example, it may be 2.00 mass % or less.

The total content of Co and Mn in the R-T-B based permanent magnet of the present embodiment may be 0.40 mass % or more. When the total content of Co and Mn is 0.40 mass % or more, the corrosion resistance is easily improved. There is no upper limit to the total content of Co and Mn, for example, it may be 1.00 mass % or less.

The R-T-B based permanent magnet of the present embodiment contains C and N.

In the R-T-B based permanent magnet of the present embodiment, the carbon content is 0.065 mass % or more and 0.200 mass % or less, may be 0.073 mass % or more and 0.202 mass % or less, and may be 0.076 mass % or more and 0.105 mass % or less. When the carbon content is within the above range, an appropriate amount of Fe-rich phase is easily formed in the grain boundaries. The Fe-rich phase is the phase having a higher concentration of Fe than in the main phase grains and having a $La_6Co_{11}Ga_3$ type crystal structure. When the carbon content is too low, the sinterability decreases, and HcJ and the corrosion resistance decrease. When the carbon content is too high, HcJ and the corrosion resistance decrease.

In the R-T-B based permanent magnet of the present embodiment, the nitrogen content is 0.023 mass % or more and 0.323 mass % or less, and may be 0.035 mass % or more and 0.096 mass % or less. When the nitrogen content is within the above range, it becomes easy to form the R—Ga—Co—Cu—N concentrated part in the grain boundaries. When the nitrogen content is too small, it becomes difficult to form the R—Ga—Co—Cu—N concentrated part, and the corrosion resistance decreases. When the nitrogen content is too high, HcJ decreases. A method of adding nitrogen to the R-T-B-based permanent magnet is not particularly limited, and as mentioned below, nitrogen may be added by heat treating the raw material alloy in a nitrogen gas atmosphere of a predetermined concentration. Nitrogen may be added by using for example an aid containing nitrogen such as urea and the like as a pulverization aid. Nitrogen may be added into the grain boundaries in the R-T-B based permanent magnet by using a compound containing nitrogen as a treating agent for the raw material alloy.

The amounts of carbon and nitrogen in the R-T-B based permanent magnet can be measured by generally known methods. The carbon content may be measured for example by a combustion in oxygen airflow-infrared absorption method. The nitrogen content may be measured for example by an inert gas fusion-thermal conductivity method.

Fe content in the R-T-B based permanent magnet of the present embodiment is substantially a balance of the constituting element of the R-T-B based permanent magnet. "Fe content is a substantial balance" specifically means, that the total content of the above-described elements other than R, T, B, M, C, and N is 1 mass % or less.

In the R-T-B based permanent magnet of the present embodiment, the R—Ga—Co—Cu—N concentrated part may be formed in the grain boundaries. The R-T-B based permanent magnet that do not form the R—Ga—Co—Cu—N concentrated part cannot sufficiently suppress the absorption of hydrogen to the grain boundaries. Hydrogen is induced by corrosion reaction due to water such as water vapor in used environment. Thus, the corrosion resistance of the R-T-B based permanent magnet tends to easily decrease.

According to the present embodiment, by forming the R—Ga—Co—Cu—N concentrated part in the grain boundaries, it is possible to effectively suppress the absorption of hydrogen to the entire grain boundaries. Hydrogen is generated by water such as water vapor and the like in used environment invading in the R-T-B based permanent magnet and reacting with R in the R-T-B based permanent magnet. Therefore, by forming the R—Ga—Co—Cu—N concentrated part in the grain boundaries, the corrosion of the R-T-B based permanent magnet can be prevented from progressing towards inside, and good magnetic properties can be obtained.

The corrosion of the R-T-B based permanent magnet progresses by the absorption of hydrogen into the R-rich phase existing in the grain boundaries of the R-T-B based permanent magnet. Hydrogen is generated by the corrosion reaction of water such as water vapor and the like in used environment and R in the R-T-B-based permanent magnet. As a result of hydrogen being absorbed in the R-rich phase, the corrosion of the R-T-B-based permanent magnet proceeds at an accelerated rate into the R-T-B-based permanent magnet.

That is, the corrosion of the R-T-B based permanent magnet is thought to progress in a process discussed in below. Since the R-rich phase existing in the grain boundaries is easily oxidized, R of the R-rich phase existing in the grain boundaries is first oxidized by water (such as water vapor and the like in used environment), and R is corroded, then forms hydroxides. During this process, hydrogen is produced.

$$2R+6H_2O \rightarrow 2R(OH)_3+3H_2 \quad \text{(I)}$$

Next, this produced hydrogen is absorbed in the R-rich phase which is not corroded.

$$2R+xH_2 \rightarrow 2RH_x \quad \text{(II)}$$

Thus, as more hydrogen are absorbed in the R-rich phase, the R-rich phase tends to be corroded easily, and due to the corrosion reaction between water and the R-rich phase in which hydrogen is absorbed, hydrogen is produced more than the hydrogen amount absorbed in the R-rich phase.

$$2RH_x+6H_2O \rightarrow 2R(OH)_3+(3+x)H_2 \quad \text{(III)}$$

Corrosion of the R-T-B based permanent magnet progresses towards inside of the R-T-B based permanent magnet due to the chain reactions of the above (I) to (III). Then, the R-rich phase changes to hydroxides of R and to hydrides of R. Due to a volume expansion associated with the changes of the R-rich phase, stress is accumulated in the R-T-B based permanent magnet which causes the crystal grains to fall off from the R-T-B based permanent magnet. Then, due to this falling of the main phase grains, a newly formed surface of the R-T-B based permanent magnet appears, and corrosion of the R-T-B based permanent magnet further progresses towards inside of the R-T-B based permanent magnet.

Therefore, the R-T-B based permanent magnet of the present embodiment tends to have the R—Ga—Co—Cu—N concentrated part in the grain boundaries, particularly in the grain boundary multiple junction. The R—Ga—Co—Cu—N concentrated part is difficult to absorb hydrogen. Thus, hydrogen generated by the corrosion reaction can be prevented from being absorbed in the R-rich phase, and the corrosion due to the above mentioned processes can be prevented from progressing toward inside. Since the R—Ga—Co—Cu—N concentrated part is less likely to be oxidized than the R-rich phase, the generation of hydrogen due to corrosion can be suppressed. Therefore, according to the R-T-B based permanent magnet of the present embodiment, the corrosion resistance of the R-T-B based permanent magnet can be greatly improved. According to the present embodiment, the R-rich phase may exist in the grain boundaries. Even if the R-rich phase exist in the grain boundaries, it is possible to effectively prevent hydrogen from being absorbed to the R-rich phase in the grain boundaries by having the R—Ga—Co—Cu—N concentrated part. Thus, it is possible to sufficiently improve the corrosion resistance.

According to the R-T-B based permanent magnet of the present embodiment, in the R—Ga—Co—Cu—N concentrated part at the grain boundaries, the number of N atoms may be 1 to 13% with respect to the sum of the number of atoms of R, Fe, Ga, Co, Cu, and N. By having the R—Ga—Co—Cu—N concentrated part containing the number of N atoms in the above-mentioned ratio, hydrogen generated by the corrosion reaction between water and R in the R-T-B based permanent magnet is effectively suppressed from being stored in the R-rich phase of the grain boundaries, and the progress of the corrosion toward inside can be prevented. The R-T-B based permanent magnet of the present embodiment can have good magnetic properties.

In the R—Ga—Co—Cu—N concentrated part, the number of Ga atoms may be 7 to 16% with respect to the sum of the number of atoms of R, Fe, Ga, Co, Cu, and N; The number of Co atoms may be 1 to 9% with respect to the sum of the number of atoms of R, Fe, Ga, Co, Cu, and N; and the number of Cu atoms may be 4 to 8% with respect to the sum of the number of atoms of R, Fe, Ga, Co, Cu, and N. By the presence of the R—Ga—Co—Cu—N concentrated part containing each atoms at the above-mentioned ratio; hydrogen generated by the corrosion reaction between water and R in the R-T-B based permanent magnet is effectively suppressed from being absorbed into the internal R-rich phase; and the progress of the corrosion toward inside can be prevented. The R-T-B based permanent magnet of the present embodiment becomes easy to have excellent magnetic properties.

The R-T-B based permanent magnet of the present embodiment can be generally used by processing into any shape. The shape of the R-T-B based permanent magnet of the present embodiment is not particularly limited It can be a columnar shape such as a rectangular parallelepiped shape, a hexahedron shape, a tabular shape, a square pole shape, and the like; a cylinder shape of which a cross section shape of the R-T-B based permanent magnet is C-shaped, and the like. As the square pole, for example, a bottom surface of the square pole may be rectangular or square.

The R-T-B based permanent magnet according to the present embodiment includes both a magnet product which has been processed and magnetized, and a magnet product which has not magnetized.

<Method of Producing R-T-B Based Permanent Magnet>

An example of method of producing the R-T-B based permanent magnet according to the present embodiment having the above-mentioned constitution is described. The method of producing the R-T-B based permanent magnet (the R-T-B based sintered magnet) according to the present embodiment includes following steps:

(a) an alloy preparation step wherein a raw material alloy is prepared;

(b) a pulverization step wherein the raw material alloy is pulverized;

(c) a pressing step wherein the obtained alloy powder is pressed;

(d) a sintering step wherein a green compact is sintered to obtain the R-T-B based permanent magnet;

(e) an aging treatment step wherein the R-T-B based permanent magnet is carried out with an aging treatment;

(f) a cooling step cooling the R-T-B based permanent magnet;

(g) a machining step wherein the R-T-B based permanent magnet is processed;

(h) a grain boundary diffusing step wherein a heavy rare earth element is diffused into the grain boundaries of the R-T-B based permanent magnet; and (i) a surface treatment step wherein the R-T-B based permanent magnet is surface treated.

[Alloy Preparation Step]

A raw material alloy having a composition of the R-T-B based permanent magnet according to the present embodiment is prepared (an alloy preparation step). In the alloy preparation step, raw material metals, corresponding to the composition of the R-T-B based permanent magnet according to the present embodiment are melted in vacuum or in inert gas atmosphere such as Ar gas and the like. Then, the melted raw material metals are casted to produce a raw material alloy having the desired compositions. According to the present embodiment, an one-alloy method is described, however, a two-alloy method in which the two alloys that is the first alloy and the second alloy are mixed to produce the raw material powder may be used.

As the raw material metals, for example, a rare earth metal or alloy of rare earth metal, pure iron, ferro-boron, compounds and alloys of these, and the like can be used. As a method of casting the raw material metals, for example, an ingot casting method, a strip casting method, a book molding method, a centrifugal casting method, and the like may be mentioned. In case solidification segregation exists in the obtained raw material alloy, a homogenization treatment is carried out if needed. In case the homogenization treatment is carried out to the raw material alloy, it is carried out in vacuum or in inert gas atmosphere and held in a temperature of 700° C. or more and 1500° C. or less for one hour or longer. Thereby, the raw material alloy is melted and homogenized.

[Pulverization Step]

After the raw material alloy is produced, the raw material alloy is pulverized (a pulverization step). The pulverization step includes a coarse pulverization step pulverizing until a particle size is several hundred μm to several mm or so, and a fine pulverization step pulverizing until a particle size is several μm or so.

(Coarse Pulverization Step)

The raw material alloy is coarsely pulverized until a particle size is several hundred μm to several mm or so (a coarse pulverization step). Thereby, coarsely pulverized powder of the raw material alloy is obtained. For example, after hydrogen is absorbed in the raw material alloy, hydrogen is released due to a different hydrogen absorption amount between the main phases and the grain boundaries and dehydrogenation is carried out which causes a self-collapsing like pulverization (hydrogen absorption pulverization), thereby the coarse pulverization can be carried out.

The added amount of nitrogen necessary for forming the R—Ga—Co—Cu—N concentrated part can be controlled by regulating the nitrogen gas concentration in the atmosphere of the dehydrogenation treatment during this hydrogen absorption pulverization. An optimum nitrogen gas concentration differs depending on the composition of the raw material alloy and the like, for example it may be preferably 300 ppm or more.

Also, other than the above-mentioned hydrogen absorption pulverization, the coarse pulverization step may be carried out by using a coarse pulverizer such as a stamp mill, a jaw crusher, a brown mill, and the like, in inert gas atmosphere.

In order to attain high magnetic properties, each step from the pulverization step to the sintering step which is described in below may be carried out in an atmosphere of a low oxygen concentration. The oxygen concentration is regulated by controlling an atmosphere of each production step. If the oxygen concentration of each production step is high, a rare earth element in the alloy powder obtained by pulverizing the raw material alloy is oxidized and oxides of R are formed. The oxides of R precipitate as oxides of R in the grain boundaries since these are not reduced during sintering. As a result, Br of the obtained R-T-B based permanent magnet decreases. Therefore, for example, the oxygen concentration of each step may be 100 ppm or less.

(Fine Pulverization Step)

After coarsely pulverizing the raw material alloy, the obtained coarsely pulverized powder of raw material alloy is finely pulverized until the average particle size is several μm or so (a fine pulverization step). Thereby, the finely pulverized powder of raw material alloy is obtained. By finely pulverizing the coarsely pulverized powder, the finely pulverized powder having the particle size of 1 μm or more to 10 μm or less, and more preferably 3 μm or more to 5 μm or less can be obtained.

The fine pulverization is carried out by further pulverizing the coarsely pulverized powder using a fine pulverizer such as a jet mill, a ball mill, a vibrating mill, a wet attritor, and the like while regulating the condition such as a pulverization time and the like accordingly. The jet mill is a method of pulverization wherein a high pressure inert gas (for example, $N_2$ gas) is released from a narrow nozzle to generate a high speed gas flow, and this high speed gas flow accelerates the coarsely pulverized powder of the raw material alloy and makes the coarsely pulverized powder of raw material alloy to collide against each other or collide the coarsely pulverized powder of the raw material alloy with a target or a container wall.

When finely pulverizing the coarsely pulverized powder of the raw material alloy, by adding a pulverization aid such as zinc stearate, urea, oleic amide, and the like, the finely pulverized powder with high orientation can be obtained in a pressing step. In addition, by controlling the added amount of the pulverization aid, it is possible to control C content, N content, and the like in the finally obtained R-T-B based permanent magnet.

[Pressing Step]

The finely pulverized powder is pressed into a desired shape (a pressing step). The pressing step is carried out by filling the finely pulverized powder in a press mold held between electromagnets and then applying pressure, thereby the finely pulverized powder is formed into a desired shape. Here, by pressurizing while applying a magnetic field, a predetermined orientation of the finely pulverized powder is formed and pressing is done in the magnetic field while crystal axis is oriented. Thus, a green compact is obtained. The obtained green compact is oriented in a specific direction; hence the R-T-B based permanent magnet having a high magnetic anisotropy is obtained.

A pressure at the time of pressing may be 30 MPa to 300 Mpa. The applied magnetic field may be 950 kA/m to 1600 kA/m. The magnetic field applied is not limited to a static magnetic field, and may be a pulsed magnetic field. Also, a static magnetic field and a pulsed magnetic field can be used in combination.

As a pressing method, in addition to dry pressing which directly presses the finely pulverized powder as described in above, wet pressing which presses a slurry having the finely pulverized powder dispersed in a solvent such as oil can be applied.

The shape of the green compact obtained by pressing the finely pulverized powder is not particularly limited, and it can be made into a desired shape such as a rectangular parallelepiped shape, a planar shape, a columnar shape, a ring shape, etc. according to the desired shape of the R-T-B based permanent magnet.

[Sintering Step]

The green compact having a desired shape obtained by pressing in a magnetic field is sintered in a vacuum or in inert gas atmosphere, and the R-T-B based permanent magnet is obtained (a sintering step). A sintering temperature needs to be regulated depending on various conditions such as a composition, a pulverization method, a difference between particle size and particle size distribution, and the like. For example, sintering is done by heating the green compact in a vacuum or in inert gas atmosphere at 1000° C. or higher and 1200° C. or lower for 1 hour or more to 48 hours or less. Thereby, the finely pulverized powder undergoes the liquid phase sintering, and the R-T-B based permanent magnet having improved volume ratio of the main phase grains can be obtained (a sintered body of the R-T-B based magnet). After obtaining the sintered body by sintering the green compact, the sintered body may be preferably rapidly cooled from the point to improve the production efficiency.

[Aging Treatment Step]

After sintering the green compact, the aging treatment is carried out to the R-T-B based permanent magnet (an aging treatment step). After sintering, the obtained R-T-B based permanent magnet is maintained under a temperature lower than in the sintering step, thereby the aging treatment of the R-T-B based permanent magnet is carried out. The condition of the aging treatment is regulated accordingly depending on the number of times of carrying out the aging treatment such as a two-step heating which heats for 10 minutes to 6 hours at temperature of 700° C. or higher and 1000° C. or lower and further heating for 10 minutes to 6 hours at temperature of 500° C. to 700° C.; or a one-step heating which heats for 10 minutes to 6 hours at temperature around 600° C. By carrying out such aging treatment, the magnetic properties of the R-T-B based permanent magnet can be improved. The aging treatment step may be carried out after the machining step mentioned below.

[Cooling Step]

After carrying out the aging treatment to the R-T-B based permanent magnet, it is rapidly cooled in Ar gas atmosphere (a cooling step). Thereby, the R-T-B based permanent magnet of the present embodiment can be obtained. The cooling rate is not particularly limited, and preferably it may be 30° C./min or more.

[Machining Step]

The obtained R-T-B based permanent magnet may be machined into a desired shape depending on the needs (a machining step). The method of machining may be, for example a shaping process such as cutting, grinding, and the like, a chamfering process such as barrel polishing, and the like.

[Grain Boundary Diffusing Step]

A step for diffusing a heavy rare earth element may be further carried out to the grain boundaries of the machined R-T-B based permanent magnet (a grain boundary diffusing step). The method of grain boundary diffusion is not particularly limited. For example, the diffusion may be carried out by heat treating after adhering the compounds including a heavy rare earth element to the surface of the R-T-B based permanent magnet by coating, a vapor deposition, and the like. Also, a method of carrying out a heat treatment to the R-T-B based permanent magnet in an atmosphere including a vapor of a heavy rare earth element may be performed. By carrying out the grain boundary diffusion, HcJ of the R-T-B based permanent magnet can be improved.

[Surface Treatment Step]

The R-T-B based permanent magnet is obtained by the above-mentioned steps, and it may be carried out with a surface treatment such as a plating, a resin coating, an oxidation treatment, a chemical conversion treatment, and the like (a surface treatment step). Thereby, the corrosion resistance can be further improved.

The present embodiment carries out the machining step, the grain boundary diffusion step, and the surface treatment step, however these steps may not be necessary.

The R-T-B based permanent magnet of the present embodiment obtained as above shows an excellent corrosion resistance and good magnetic properties.

The R-T-B based permanent magnet obtained as such has a high corrosion resistance thus it can be used for long period of time when used as a magnet of a rotary machine such as motor and the like, thus provides highly reliable R-T-B based permanent magnet. The R-T-B based permanent magnet according to the present embodiment is suitably used as a magnet of surface magnet type (Surface Permanent Magnet: SPM) motor wherein a magnet is attached on the surface of a rotor, an interior magnet embedded type (Interior Permanent Magnet: IPM) motor such as inner rotor type brushless motor, PRM (Permanent magnet Reluctance Motor), and the like. Specifically, the R-T-B based permanent magnet according to the present embodiment is suitably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a generator, and the like.

The present invention is not limited to the above embodiments and can be varied within the scope of the present invention.

The method of producing of the R-T-B based permanent magnet is not limited to the above methods and can be suitably varied. For instance, the R-T-B based permanent magnet of the present embodiment can be produced by a hot-forming method. The producing method of the R-T-B based permanent magnet by carrying out the hot-forming method includes the following steps:

(a) a melting and quenching step of melting raw material metals and quenching the resulting molten metal to obtain a ribbon;

(b) a pulverization step of pulverizing the ribbon to obtain a flake-like raw material powder;

(c) a cold forming step of cold-forming the pulverized raw material powder;

(d) a preheating step of preheating the cold-formed body;

(e) a hot forming step of hot-forming the preheated cold-formed body;

(f) a hot plastic deforming step of plastically deforming the hot-formed body into a predetermined shape; and (g) an aging treatment step of aging an R-T-B based permanent magnet.

EXAMPLES

Next, the present invention is described based on specific examples, however the present invention is not limited thereto.

First, in order to obtain permanent magnets having the magnetic compositions shown in Tables 1 to 9, a raw material alloy was prepared by a strip casting method. The unit of the content of each element shown in Tables 1 to 9 is mass %.

Next, hydrogen was absorbed to the raw material alloy at room temperature, and then subjected to a hydrogen pulverization treatment (coarse pulverization) by carrying out a dehydrogenation treatment in Ar atmosphere at 600° C. for one hour, and the alloy powder was obtained.

In the present examples, each step from the hydrogen pulverization treatment to sintering (fine pulverization and pressing) was carried out in Ar atmosphere under oxygen concentration of less than 50 ppm.

Next, zinc stearate and urea were added and mixed to the alloy powder as a pulverization aid using a Nauta mixer. The added amounts of zinc stearate ($(C_{18}H_{35}O_2)_2Zn$) and urea ($CH_4N_2O$) were appropriately controlled so that the carbon content and the nitrogen content of the R-T-B based permanent magnet obtained at the end were as shown in Tables 1 to 9. Thereafter, a fine pulverization was performed using the jet mill to obtain finely pulverized powder having an average particle size of 3.0 μm or so.

The obtained finely pulverized powder was filled in a press mold held between electromagnets, a pressure of 120 MPa was applied while applying a magnetic field of 1200 kA/m, and a green compact was obtained by pressing in a magnetic field.

Then, the obtained green compact was sintered by maintaining it in vacuumed atmosphere at 1040° C. for 8 hours, followed by rapid cooling, thereby a sintered body having the magnetic composition shown in Tables 1 to 9 was obtained. Then, the obtained sintered body was carried out with a two-step aging treatment of 1 hour at 900° C. and 2 hours at 540° C. (both in Ar gas atmosphere), thereby the R-T-B based permanent magnet was obtained.

<Evaluation>

[Composition Analysis]

The R-T-B based permanent magnet of each example and comparative example were subjected to a composition analysis by a fluorescent X-ray spectroscopy, an induction coupled plasma analysis method (an ICP method), and a gas analysis method. The concentration of carbon was measured by a combustion in oxygen airflow-infrared absorption method. The concentration of nitrogen was measured by an inert gas fusion-thermal conductivity method. As a result, the compositions of all of the R-T-B based permanent magnets were confirmed to show the magnetic compositions shown in Tables 1 to 9.

[Magnetic Properties]

Magnetic properties of the R-T-B based permanent magnet according to each example and comparative example were measured by a B-H tracer. As the magnetic properties, Br and HcJ were measured. Results are shown in Tables 1 to 9. Br was considered good when it was 1360 mT or more, and excellent when it was 1370 mT or more. HcJ was considered good when 1560 kA/m or more, and excellent when it was 1600 kA/m or more.

[Corrosion Resistance]

The R-T-B based permanent magnet of each example and comparative example obtained was machined into a plate form of 15 mm×10 mm×2 mm. Then, this plate form magnet was left in a saturated water vapor atmosphere of 100% relative humidity at 120° C., 2 atmospheric pressure for 200 hours. A weight loss amount due to corrosion was evaluated. Results are shown in Tables 1 to 9. The weight loss amount of 10.0 mg/cm$^2$ or less was considered a good corrosion resistance, and 6.0 mg/cm$^2$ or less was considered excellent corrosion resistance.

TABLE 1

| Sample No. | Ex./Comp. Ex. | R | Nd | Pr | Co | B | M | Cu | Al | Zr | Ga | Mn |
|---|---|---|---|---|---|---|---|---|---|---|---|---|
| 2 | Comp. Ex. | 31.7 | 25.7 | 6.0 | 0.08 | 0.90 | 1.72 | 0.55 | 0.10 | 0.22 | 0.82 | 0.03 |
| 3 | Ex. | 31.7 | 25.7 | 6.0 | 0.10 | 0.90 | 1.72 | 0.55 | 0.10 | 0.22 | 0.82 | 0.03 |
| 4 | Ex. | 31.7 | 25.7 | 6.0 | 0.20 | 0.90 | 1.72 | 0.55 | 0.10 | 0.22 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 5a | Ex. | 31.7 | 25.7 | 6.0 | 0.42 | 0.90 | 1.72 | 0.55 | 0.10 | 0.22 | 0.82 | 0.03 |
| 5 | Ex. | 31.7 | 25.7 | 6.0 | 0.44 | 0.90 | 1.72 | 0.55 | 0.10 | 0.22 | 0.82 | 0.03 |
| 6 | Comp. Ex. | 31.7 | 25.7 | 6.0 | 0.87 | 0.90 | 1.72 | 0.55 | 0.10 | 0.22 | 0.82 | 0.03 |

| Sample No. | C | N | Co + Al + Cu | Co + Mn | Br/mT | HcJ/kA m$^{-1}$ | Weight Loss Amount/mg cm$^{-2}$ |
|---|---|---|---|---|---|---|---|
| 2 | 0.076 | 0.054 | 0.73 | 0.11 | 1395 | 1711 | 20.1 |
| 3 | 0.076 | 0.054 | 0.75 | 0.13 | 1393 | 1706 | 9.7 |
| 4 | 0.076 | 0.054 | 0.85 | 0.23 | 1389 | 1664 | 4.3 |
| 1 | 0.076 | 0.054 | 1.04 | 0.42 | 1378 | 1615 | 2.5 |
| 5a | 0.076 | 0.054 | 1.07 | 0.45 | 1371 | 1605 | 1.8 |
| 5 | 0.076 | 0.054 | 1.09 | 0.47 | 1365 | 1567 | 1.0 |
| 6 | 0.076 | 0.054 | 1.52 | 0.90 | 1359 | 1531 | 0.5 |

TABLE 2

| Sample No. | Ex./Comp. Ex. | R | Nd | Pr | Co | B | M | Cu | Al | Zr | Ga | Mn |
|---|---|---|---|---|---|---|---|---|---|---|---|---|
| 7 | Comp. Ex. | 31.7 | 25.7 | 6.0 | 0.39 | 0.90 | 1.67 | 0.50 | 0.10 | 0.22 | 0.82 | 0.03 |
| 8 | Ex. | 31.7 | 25.7 | 6.0 | 0.39 | 0.90 | 1.70 | 0.53 | 0.10 | 0.22 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 9 | Ex. | 31.7 | 25.7 | 6.0 | 0.39 | 0.90 | 1.97 | 0.80 | 0.10 | 0.22 | 0.82 | 0.03 |
| 10 | Ex. | 31.7 | 25.7 | 6.0 | 0.39 | 0.90 | 2.14 | 0.97 | 0.10 | 0.22 | 0.82 | 0.03 |
| 11 | Comp. Ex. | 31.7 | 25.7 | 6.0 | 0.39 | 0.90 | 2.36 | 1.19 | 0.10 | 0.22 | 0.82 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 7 | 0.076 | 0.054 | 0.99 | 0.42 | 1385 | 1601 | 13.1 |
| 8 | 0.076 | 0.054 | 1.02 | 0.42 | 1381 | 1609 | 7.9 |
| 1 | 0.076 | 0.054 | 1.04 | 0.42 | 1378 | 1615 | 2.5 |
| 9 | 0.076 | 0.054 | 1.29 | 0.42 | 1371 | 1656 | 2.5 |
| 10 | 0.076 | 0.054 | 1.46 | 0.42 | 1365 | 1610 | 2.3 |
| 11 | 0.076 | 0.054 | 1.68 | 0.42 | 1356 | 1609 | 2.2 |

TABLE 3

| Sample No. | Ex./Comp. Ex. | R | Nd | Pr | Co | B | M | Cu | Al | Zr | Ga | Mn |
|---|---|---|---|---|---|---|---|---|---|---|---|---|
| 13 | Ex. | 31.7 | 25.7 | 6.0 | 0.39 | 0.90 | 1.70 | 0.55 | 0.08 | 0.22 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 14 | Ex. | 31.8 | 25.8 | 6.0 | 0.39 | 0.90 | 1.81 | 0.55 | 0.19 | 0.22 | 0.82 | 0.03 |
| 15 | Ex. | 31.8 | 25.8 | 6.0 | 0.39 | 0.90 | 2.03 | 0.55 | 0.41 | 0.22 | 0.82 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 13 | 0.076 | 0.054 | 1.02 | 0.42 | 1384 | 1574 | 2.2 |
| 1 | 0.076 | 0.054 | 1.04 | 0.42 | 1378 | 1615 | 2.5 |
| 14 | 0.077 | 0.054 | 1.13 | 0.42 | 1371 | 1649 | 1.9 |
| 15 | 0.077 | 0.054 | 1.35 | 0.42 | 1361 | 1641 | 1.4 |

TABLE 4

| Sample No. | Ex./Comp. Ex. | R | Nd | Pr | Co | B | M | Cu | Al | Zr | Ga | Mn |
|---|---|---|---|---|---|---|---|---|---|---|---|---|
| 17 | Comp. Ex. | 31.7 | 25.7 | 6.0 | 0.39 | 0.90 | 1.01 | 0.55 | 0.10 | 0.22 | 0.11 | 0.03 |
| 18 | Ex. | 31.7 | 25.7 | 6.0 | 0.39 | 0.90 | 1.03 | 0.55 | 0.10 | 0.22 | 0.13 | 0.03 |
| 19 | Ex. | 31.7 | 25.7 | 6.0 | 0.39 | 0.90 | 1.45 | 0.55 | 0.10 | 0.22 | 0.55 | 0.03 |
| 1 | Ex. | 31.7 | 25.7 | 6.0 | 0.39 | 0.90 | 1.72 | 0.55 | 0.10 | 0.22 | 0.82 | 0.03 |
| 20 | Ex. | 31.7 | 25.7 | 6.0 | 0.39 | 0.90 | 1.96 | 0.55 | 0.10 | 0.22 | 1.06 | 0.03 |
| 21 | Comp. Ex. | 31.7 | 25.7 | 6.0 | 0.39 | 0.90 | 1.98 | 0.55 | 0.10 | 0.22 | 1.08 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 17 | 0.077 | 0.054 | 1.04 | 0.42 | 1401 | 1511 | 13.4 |
| 18 | 0.077 | 0.054 | 1.04 | 0.42 | 1399 | 1587 | 8.2 |
| 19 | 0.076 | 0.054 | 1.04 | 0.42 | 1370 | 1622 | 5.1 |
| 1 | 0.076 | 0.054 | 1.04 | 0.42 | 1378 | 1615 | 2.5 |
| 20 | 0.076 | 0.054 | 1.04 | 0.42 | 1362 | 1632 | 2.0 |
| 21 | 0.076 | 0.054 | 1.04 | 0.42 | 1351 | 1678 | 1.7 |

TABLE 5

| Sample No. | Ex./Comp. Ex. | R | Nd | Pr | Co | B | M | Cu | Al | Zr | Ga | Mn |
|---|---|---|---|---|---|---|---|---|---|---|---|---|
| 23 | Ex. | 31.7 | 25.7 | 6.0 | 0.39 | 0.90 | 1.65 | 0.55 | 0.10 | 0.15 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 24 | Ex. | 31.7 | 25.7 | 6.0 | 0.39 | 0.90 | 1.81 | 0.55 | 0.10 | 0.31 | 0.82 | 0.03 |
| 25 | Ex. | 31.7 | 25.7 | 6.0 | 0.39 | 0.90 | 1.92 | 0.55 | 0.10 | 0.42 | 0.82 | 0.03 |

TABLE 5-continued

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 23 | 0.076 | 0.054 | 1.04 | 0.42 | 1381 | 1608 | 9.3 |
| 1 | 0.076 | 0.054 | 1.04 | 0.42 | 1378 | 1615 | 2.5 |
| 24 | 0.076 | 0.054 | 1.04 | 0.42 | 1370 | 1617 | 2.5 |
| 25 | 0.076 | 0.054 | 1.04 | 0.42 | 1361 | 1620 | 2.2 |

TABLE 6

| Sample No. | Ex./Comp. Ex. | R | Nd | Pr | Co | B | M | Cu | Al | Zr | Ga | Mn |
|---|---|---|---|---|---|---|---|---|---|---|---|---|
| 28 | Ex. | 31.7 | 25.7 | 6.0 | 0.39 | 0.90 | 1.71 | 0.55 | 0.10 | 0.22 | 0.82 | 0.02 |
| 1 | Ex. | 31.7 | 25.7 | 6.0 | 0.39 | 0.90 | 1.72 | 0.55 | 0.10 | 0.22 | 0.82 | 0.03 |
| 29 | Ex. | 31.7 | 25.7 | 6.0 | 0.39 | 0.90 | 1.74 | 0.55 | 0.10 | 0.22 | 0.82 | 0.05 |
| 30 | Ex. | 31.7 | 25.7 | 6.0 | 0.39 | 0.90 | 1.77 | 0.55 | 0.10 | 0.22 | 0.82 | 0.08 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 28 | 0.076 | 0.054 | 1.04 | 0.41 | 1379 | 1619 | 8.9 |
| 1 | 0.076 | 0.054 | 1.04 | 0.42 | 1378 | 1615 | 2.5 |
| 29 | 0.076 | 0.054 | 1.04 | 0.44 | 1375 | 1601 | 2.0 |
| 30 | 0.076 | 0.054 | 1.04 | 0.47 | 1362 | 1588 | 0.9 |

TABLE 7

| Sample No. | Ex./Comp. Ex | R | Nd | Pr | Co | B | M | Cu | Al | Zr | Ga | Mn |
|---|---|---|---|---|---|---|---|---|---|---|---|---|
| 32 | Comp. Ex | 31.6 | 25.6 | 6.0 | 0.38 | 0.78 | 1.71 | 0.55 | 0.10 | 0.22 | 0.81 | 0.03 |
| 33 | Ex. | 31.6 | 25.6 | 6.0 | 0.38 | 0.80 | 1.71 | 0.55 | 0.10 | 0.22 | 0.81 | 0.03 |
| 1 | Ex. | 31.7 | 25.7 | 6.0 | 0.39 | 0.90 | 1.72 | 0.55 | 0.10 | 0.22 | 0.82 | 0.03 |
| 34 | Ex. | 31.8 | 25.8 | 6.0 | 0.39 | 0.96 | 1.72 | 0.55 | 0.10 | 0.22 | 0.82 | 0.03 |
| 35 | Comp. Ex | 31.8 | 25.8 | 6.0 | 0.39 | 0.98 | 1.72 | 0.55 | 0.10 | 0.22 | 0.82 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 32 | 0.076 | 0.053 | 1.03 | 0.41 | 1381 | 1547 | 6.6 |
| 33 | 0.076 | 0.053 | 1.03 | 0.41 | 1378 | 1661 | 5.4 |
| 1 | 0.076 | 0.054 | 1.04 | 0.42 | 1378 | 1615 | 2.5 |
| 34 | 0.077 | 0.054 | 1.04 | 0.42 | 1366 | 1591 | 8.5 |
| 35 | 0.077 | 0.054 | 1.04 | 0.42 | 1354 | 1581 | 22.0 |

TABLE 8

| Sample No. | Ex./Comp. Ex | R | Nd | Pr | Co | B | M | Cu | Al | Zr | Ga | Mn |
|---|---|---|---|---|---|---|---|---|---|---|---|---|
| 36 | Comp. Ex. | 31.7 | 25.7 | 6.0 | 0.39 | 0.90 | 1.72 | 0.55 | 0.10 | 0.22 | 0.82 | 0.03 |
| 37 | Ex. | 31.7 | 25.7 | 6.0 | 0.39 | 0.90 | 1.72 | 0.55 | 0.10 | 0.22 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 38 | Ex. | 31.8 | 25.8 | 6.0 | 0.39 | 0.90 | 1.72 | 0.55 | 0.10 | 0.22 | 0.82 | 0.03 |
| 39 | Ex. | 31.8 | 25.8 | 6.0 | 0.39 | 0.90 | 1.72 | 0.55 | 0.10 | 0.22 | 0.82 | 0.03 |
| 40 | Comp. Ex. | 31.8 | 25.8 | 6.0 | 0.39 | 0.89 | 1.72 | 0.55 | 0.10 | 0.22 | 0.82 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 36 | 0.064 | 0.054 | 1.04 | 0.42 | 1357 | 1545 | 13.4 |
| 37 | 0.073 | 0.054 | 1.04 | 0.42 | 1364 | 1584 | 8.3 |
| 1 | 0.076 | 0.054 | 1.04 | 0.42 | 1378 | 1615 | 2.5 |
| 38 | 0.105 | 0.054 | 1.04 | 0.42 | 1375 | 1630 | 1.9 |
| 39 | 0.202 | 0.054 | 1.04 | 0.42 | 1374 | 1577 | 9.2 |
| 40 | 0.225 | 0.054 | 1.04 | 0.42 | 1368 | 1542 | 18.7 |

TABLE 9

| Sample No. | Ex./Comp. Ex | R | Nd | Pr | Co | B | M | Cu | Al | Zr | Ga | Mn |
|---|---|---|---|---|---|---|---|---|---|---|---|---|
| 43 | Comp. Ex. | 31.7 | 25.7 | 6.0 | 0.39 | 0.89 | 1.72 | 0.55 | 0.10 | 0.22 | 0.82 | 0.03 |
| 44 | Ex. | 31.7 | 25.7 | 6.0 | 0.39 | 0.90 | 1.72 | 0.55 | 0.10 | 0.22 | 0.82 | 0.03 |
| 45a | Ex. | 31.7 | 25.7 | 6.0 | 0.39 | 0.90 | 1.72 | 0.55 | 0.10 | 0.22 | 0.82 | 0.03 |
| 1 | Ex. | 31.7 | 25.7 | 6.0 | 0.39 | 0.90 | 1.72 | 0.55 | 0.10 | 0.22 | 0.82 | 0.03 |
| 45 | Ex. | 32.0 | 25.9 | 6.1 | 0.39 | 0.90 | 1.72 | 0.55 | 0.10 | 0.22 | 0.82 | 0.03 |
| 46 | Ex. | 32.0 | 25.9 | 6.1 | 0.39 | 0.90 | 1.72 | 0.55 | 0.10 | 0.22 | 0.82 | 0.03 |
| 47 | Comp. Ex. | 32.0 | 25.9 | 6.1 | 0.39 | 0.90 | 1.72 | 0.55 | 0.10 | 0.22 | 0.82 | 0.03 |

| Sample No. | C | N | Co + Al + Cu | Co + Mn | Br/mT | HcJ/kA $m^{-1}$ | Weight Loss Amount/mg $cm^{-2}$ |
|---|---|---|---|---|---|---|---|
| 43 | 0.076 | 0.017 | 1.04 | 0.42 | 1380 | 1697 | 18.7 |
| 44 | 0.076 | 0.023 | 1.04 | 0.42 | 1378 | 1681 | 9.1 |
| 45a | 0.076 | 0.035 | 1.04 | 0.42 | 1378 | 1647 | 2.7 |
| 1 | 0.076 | 0.054 | 1.04 | 0.42 | 1378 | 1615 | 2.5 |
| 45 | 0.077 | 0.096 | 1.04 | 0.42 | 1371 | 1601 | 2.3 |
| 46 | 0.077 | 0.323 | 1.04 | 0.42 | 1369 | 1573 | 2.2 |
| 47 | 0.077 | 0.353 | 1.04 | 0.42 | 1366 | 1542 | 1.9 |

According to Tables 1 to 9, each example having contents of all components within a predetermined range showed good Br and HcJ, and a good corrosion resistance.

Comparative examples having a content of any component out of the predetermined range showed deterioration in Br, HcJ, and/or a corrosion resistance.

What is claimed is:

1. An R-T-B based permanent magnet in which R is one or more rare earth elements, T is a combination of Fe and Co, and B is boron, wherein the R-T-B based permanent magnet comprises M, C, and N, M is three or more selected from Cu, Ga, Mn, Zr, and Al, and comprises at least Cu, Ga, and Mn, and relative to 100 mass % of the R-T-B based permanent magnet:

a total content of R is 29.0 mass % or more and 33.5 mass % or less,

Co content is 0.10 mass % or more and 0.49 mass % or less,

B content is 0.80 mass % or more and 0.96 mass % or less, a total content of M is 0.66 mass % or more and 4.00 mass % or less, Cu content is 0.51 mass % or more and 0.97 mass % or less, Ga content is 0.12 mass % or more and 1.07 mass % or less, Mn content is 0.03 mass % or more and 0.08 mass % or less, C content is 0.065 mass % or more and 0.200 mass % or less, N content is 0.023 mass % or more and 0.323 mass % or less, and Fe is a substantial balance.

2. The R-T-B based permanent magnet according to claim 1, wherein Zr content is 0.15 mass % or more and 0.42 mass % or less.

3. The R-T-B based permanent magnet according to claim 1, wherein Al content is 0.08 mass % or more and 0.41 mass % or less.

4. The R-T-B based permanent magnet according to claim 1, wherein a total content of Co, Cu, and Al is 1.00 mass % or more and 2.00 mass % or less.

5. The R-T-B based permanent magnet according to claim 1, wherein a total content of Co and Mn is 0.40 mass % or more and 1.00 mass % or less.

* * * * *